US011073316B2

(12) United States Patent
Kim et al.

(10) Patent No.: US 11,073,316 B2
(45) Date of Patent: Jul. 27, 2021

(54) ELECTRIC COMPRESSOR

(71) Applicant: Hanon Systems, Daejeon (KR)

(72) Inventors: Hong Min Kim, Daejeon (KR); Soo Cheol Jeong, Daejeon (KR); Kweon Soo Lim, Daejeon (KR); Jae Hoon Lim, Daejeon (KR); In Cheol Shin, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 16/314,566

(22) PCT Filed: Feb. 14, 2018

(86) PCT No.: PCT/KR2018/001951
§ 371 (c)(1),
(2) Date: Dec. 31, 2018

(87) PCT Pub. No.: WO2018/151538
PCT Pub. Date: Aug. 23, 2018

(65) Prior Publication Data

US 2019/0360734 A1 Nov. 28, 2019

(30) Foreign Application Priority Data

Feb. 20, 2017 (KR) ..... 10-2017-0022412

(51) Int. Cl.
*F25B 43/02* (2006.01)
*F04C 29/06* (2006.01)
*F04C 29/12* (2006.01)

(52) U.S. Cl.
CPC ..... *F25B 43/02* (2013.01); *F04C 29/068* (2013.01); *F04C 29/12* (2013.01); *F04C 2240/30* (2013.01)

(58) Field of Classification Search
CPC .... F04C 29/068; F04C 29/12; F04C 2240/30; F25B 43/02
(Continued)

(56) References Cited

U.S. PATENT DOCUMENTS

2002/0197169 A1 12/2002 Ahn

FOREIGN PATENT DOCUMENTS

JP 2778585 B2 7/1998
KR 20100103139 A * 9/2010
(Continued)

OTHER PUBLICATIONS

English Translation of KR-20100103139-A (Wan) obtained Aug. 28, 2020 (Year: 2020).*
(Continued)

*Primary Examiner* — Connor J Tremarche
(74) *Attorney, Agent, or Firm* — Norton Rose Fulbright US LLP; James R. Crawford

(57) ABSTRACT

Disclosed herein may be an electric compressor. The electric compressor may include: a rear housing having a discharge chamber into which refrigerant is discharged; and an oil separator disposed in the discharge chamber and having a refrigerant inlet hole through which the refrigerant is drawn into the oil separator. The discharge chamber may protrude in a multi-stepped manner outwards from the rear housing such that a volume of the rear housing is increased, and based on the oil separator, an internal space of the discharge chamber may be divided into spaces having different volumes.

14 Claims, 8 Drawing Sheets

(58) Field of Classification Search
USPC ..... 417/313
See application file for complete search history.

(56) References Cited

FOREIGN PATENT DOCUMENTS

| | | | | |
|---|---|---|---|---|
| KR | 20100103139 | A | | 9/2010 |
| KR | 20130126837 | A | * | 11/2013 |
| KR | 20130126837 | A | | 11/2013 |
| KR | 20140127081 | A | | 11/2014 |
| KR | 20160108036 | A | | 9/2016 |
| KR | 101681590 | B1 | | 12/2016 |

OTHER PUBLICATIONS

English Translation of KR-20130126837-A (Kwon) obtained Sep. 12, 2020 (Year: 2020).*

* cited by examiner

ELECTRIC COMPRESSOR

CROSS-REFERENCE TO RELATED APPLICATION(S)

This application is a national phase under 35 U.S.C. § 371 of International Application No. PCT/KR2018/001951 filed Feb. 14, 2018, which claims the benefit of priority from Korean Patent Application No. 10-2017-0022412 filed on Feb. 20, 2017, which are hereby incorporated by reference in their entireties.

BACKGROUND OF THE DISCLOSURE

Field of the Disclosure

Exemplary embodiments of the present disclosure relate to an electric compressor configured to minimize vibration noise which is generated when high-pressure refrigerant is discharged into a rear housing having a discharge chamber into which the refrigerant is discharged.

Description of the Related Art

Generally, a compressor used in an air conditioning system sucks refrigerant that is evaporated by an evaporator, converts it into a high-temperature and high-pressure state, which can be easily liquefied, and then transfers it to a condenser. The compressor is operated to compress refrigerant transferred via the evaporator.

Compressors are classified into a reciprocating compressor in which a driving source for compressing refrigerant performs reciprocating motion to compress refrigerant, and a rotary compressor in which a drive source performs rotational motion to compress refrigerant. Reciprocating compressors are classified into a crank type in which driving force of a driving source is transmitted by a plurality of pistons using a crank, a swash plate type in which driving force is transmitted by a rotating shaft provided with a swash plate, and a wobble plate type using a wobble plate.

Rotary compressors are classified into a vane rotary type using a rotary shaft and a vane, and a scroll type using a turning scroll and a fixed scroll. In all of the rotary compressors, the swash plate type compressors, and the wobble plate type compressors, vibrations are generated when high-pressure refrigerant is discharged to a discharge chamber. If the vibrations are continuously generated for more than a predetermined time without being damped, a pulsation phenomenon due to vibration noise is induced in a rear housing having the discharge chamber.

Referring to FIG. 1, an electric compressor includes a rear housing 10 having a discharge chamber 11 into which refrigerant is discharged. When viewed from the outside of the electric compressor, the rear housing 10 has a planar shape. Hence, the discharge chamber 11 has a limited volume. Furthermore, as shown in the drawing, an oil separator 20 is slantly disposed in the rear housing 10.

However, in the conventional art, as described above, when high-pressure refrigerant is discharged into the discharge chamber 11, vibration noise is generated by vibrations of the rear housing 10, thus leading to abnormal vibrations of a vehicle or an air conditioning system provided with the electric compressor. Therefore, measures for solving the above problems are required.

SUMMARY OF THE DISCLOSURE

An object of the present disclosure is to provide an electric compressor in which a discharge chamber of a rear housing has an increased internal volume, thus minimizing vibration and noise which are generated by discharge of refrigerant.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, an electric compressor may include: a rear housing 100 having a discharge chamber 110 into which refrigerant is discharged; and an oil separator 200 disposed in the discharge chamber 110 and having a refrigerant inlet hole 202 into which the refrigerant is drawn into the oil separator 200. The discharge chamber 110 may protrude in a multi-stepped manner outwards from the rear housing 100 such that the volume of the rearing housing 100 is increased, and based on the oil separator 200, the internal space of the discharge chamber 110 is divided into two spaces having different volumes.

The discharge chamber 110 may include a first chamber 112 partially protruding a predetermined length in a protruding direction from the rear housing 100, a second chamber 114 partially protruding from a protruding end of the first chamber 112 at one side based on the oil separator 200, and a third chamber 116 directly protruding in the protruding direction at the other side based on the oil separator 200.

The second chamber 114 may have a volume greater than that of the first chamber 112 or the third chamber 116.

The length that the second chamber 114 protrudes in the protruding direction of the rear housing 100 may be greater than the length that the first or third chamber 112 or 116 protrudes.

A rib 300 extending in a circumferential direction of the rear housing 100 may be provided in the second chamber 114.

The rib 300 may include a first rib 310 formed in an annular shape in the second chamber 114, and a plurality of second ribs 320 radially extending from the first rib 310.

A plurality of third ribs 330 separated from each other may be provided inside the second chamber 114 along a circumferential direction of the second chamber 114.

The thickness of the first rib 310 may differ from that of the second rib 320.

The thickness of the first rib 310 may be greater than that of the second rib 320.

The oil separator 200 may be eccentrically disposed at one side based on a center of the rear housing 100.

A partition wall 400 may be disposed at one side of the discharge chamber, and provided to partition the internal space of the discharge chamber 110 into different regions.

Communication holes 410 may be formed in the partition wall 400 at different positions.

A volume ratio of the discharge chamber 110 is determined depending on an internal volume V1 of the discharge chamber 110 having a predetermined size and a discharge capacity (cc) of refrigerant which is discharged into the discharge chamber 110. The volume ratio of the discharge chamber 110 may be a value obtained by dividing the internal volume V1 of the discharge chamber 110 by the refrigerant discharge capacity (cc), and the volume ratio of the discharge chamber 110 may range from 2.0 to 3.2.

The discharge chamber 110 may include a first region S1 having a largest area among a plurality of regions disposed at different positions by the oil separator 200, a second region S2 having an area comparatively smaller than that of the first region S1, and a third area S3 disposed adjacent to the refrigerant inlet hole 202 at a position neighboring the second region S2.

The first region S1 may have a semicircular shape, and while refrigerant discharged into the first region S1 is diffused in the first region S1 or moved in a circumferential direction, noise reduction is obtained.

In the discharge chamber 110, the rib 300 is formed at one side adjacent to the oil separator 200, and the rib 300 is not formed at the other side of the oil separator 200.

The electric compressor in accordance with an embodiment of the present disclosure may be installed in an air conditioning system for vehicles.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Figure 1:
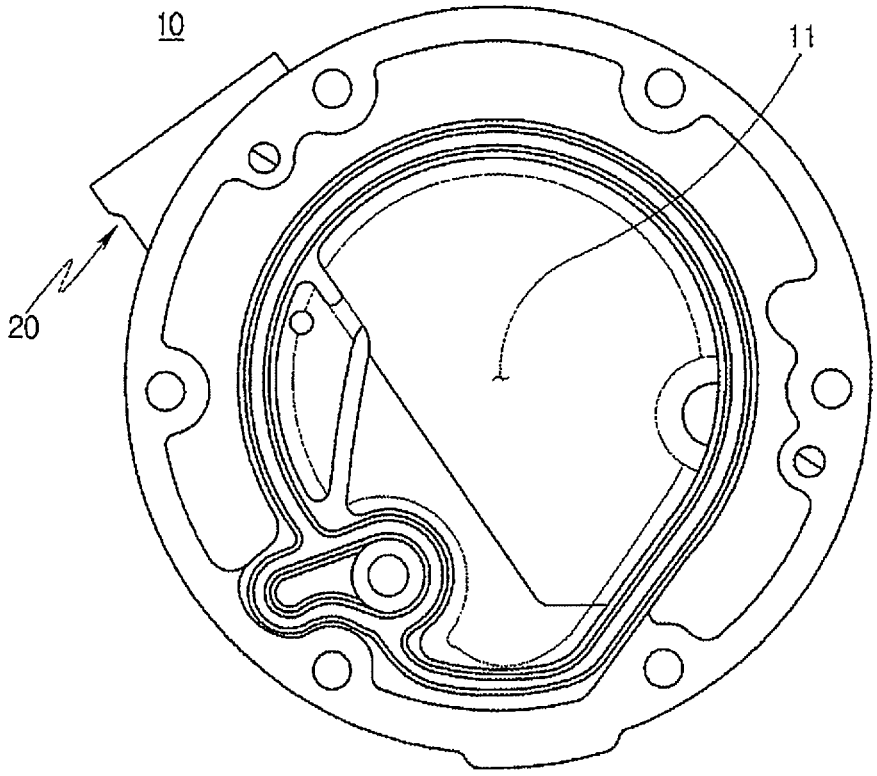
FIG. 1 is a diagram illustrating a rear housing provided in a conventional electric compressor.

Terms or words used hereinafter should not be construed as having common or dictionary meanings, but should be construed as having meanings and concepts that comply with the technical spirit of the present disclosure on the basis of the principle that the inventor may appropriately define the concepts of the terms in order to best describe his or her disclosure. Accordingly, the following description and drawings illustrate exemplary embodiments of the present disclosure and do not fully represent the scope of the present disclosure. It would be understood by one of ordinary skill in the art that a variety of equivalents and modifications of the embodiments exist.

Embodiments of the present disclosure are described in detail below with reference to the accompanying drawings.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Figure 2:
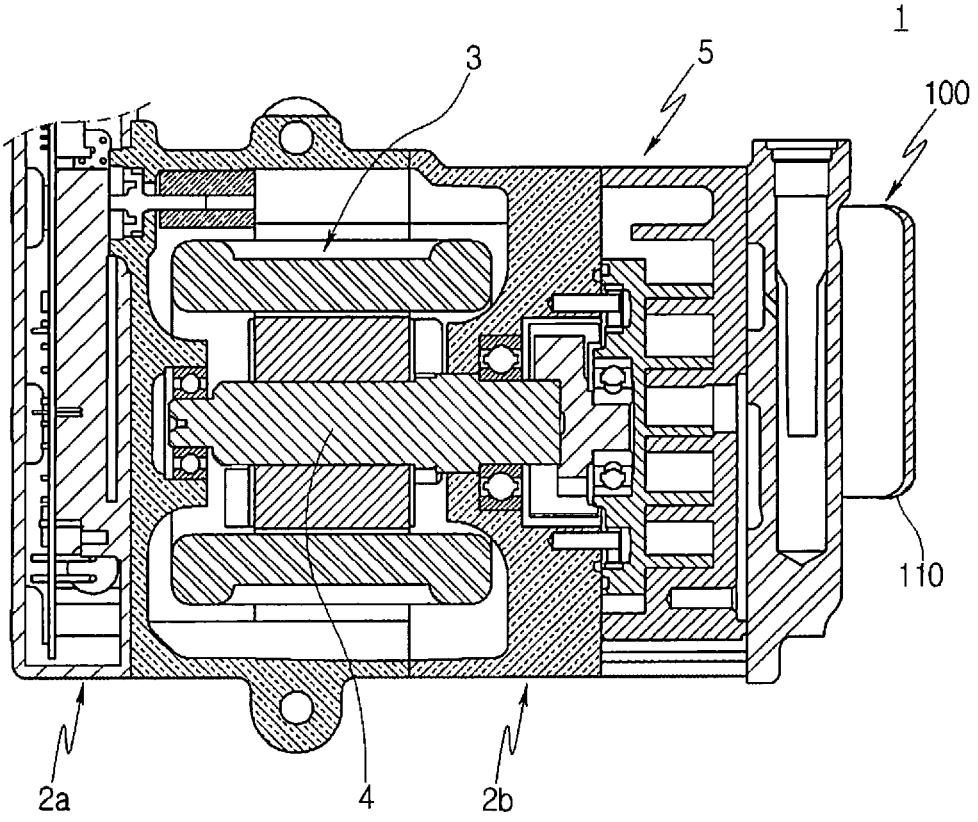
FIG. 2 is a sectional view illustrating an electric compressor in accordance with an embodiment of the present disclosure.

Hereinafter, an electric compressor in accordance with to an embodiment of the present invention will be described with reference to the accompanying drawings. FIG. 2 is a sectional view illustrating an electric compressor in accordance with the embodiment of the present disclosure, FIG. 3 is a side view illustrating a rear housing of the electric compressor in accordance with the embodiment of the present disclosure, and FIG. 4 is a diagram illustrating an internal structure of the rear housing of the electric compressor in accordance with the embodiment of the present disclosure.

Figure 3:
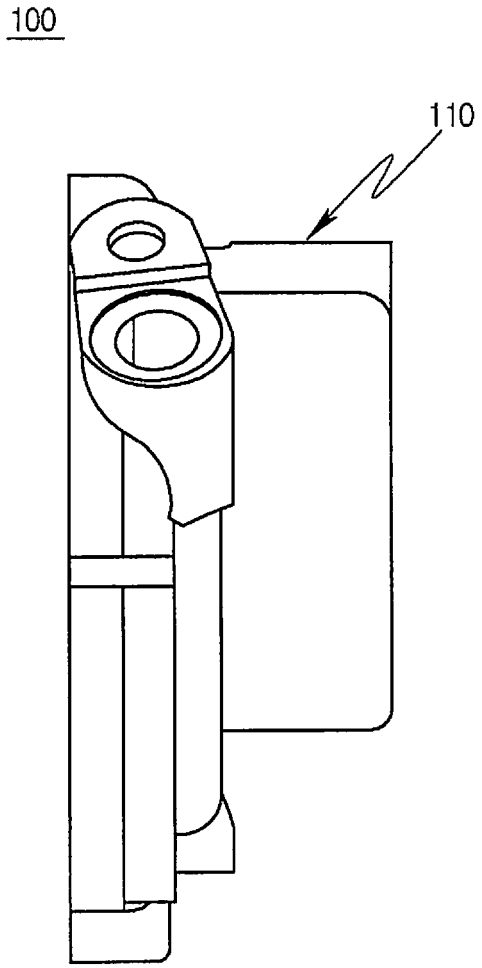
FIG. 3 is a side view illustrating a rear housing of the electric compressor in accordance with the embodiment of the present disclosure.
Figure 4:
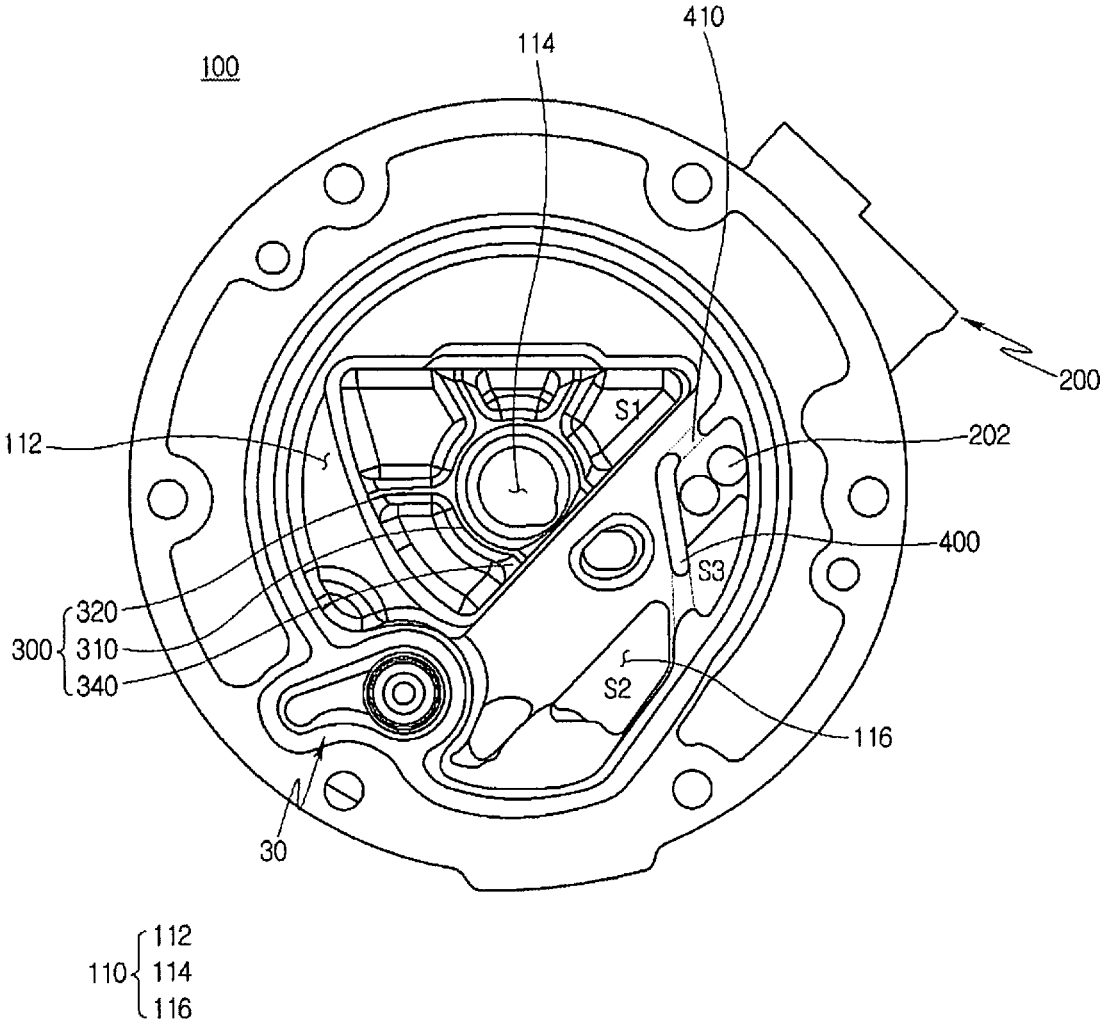
FIG. 4 is a diagram illustrating an internal structure of the rear housing of the electric compressor in accordance with the embodiment of the present disclosure.

Referring to FIGS. 2 to 4, the electric compressor 1 in accordance with the embodiment of the present disclosure is configured such that oil included in refrigerant can be separated from the refrigerant, and a discharge chamber 110 has an increased internal volume to minimize generation of vibration or noise in the rear housing 100 due to discharge of the refrigerant so that problems resulting from the vibration or noise can be prevented from occurring.

Although in this embodiment the electric compressor is described as being used in an air conditioning system for vehicles, it may also be used in an industrial compression unit or an air conditioning system for home use.

The electric compressor 1 includes a front housing 2*a* which is formed adjacent to an inlet port through which refrigerant is drawn into the electric compressor 1, an intermediate housing 2*b*, and the rear housing 100. The front housing 2*a*, the intermediate housing 2*b*, and the rear housing 100 form the appearance of the electric compressor 1. A drive unit 3 and a compression unit 5 are installed in the intermediate housing 2*b*. The drive unit 3 includes a stator, a rotor, and a rotating shaft 4 which is disposed in a central portion of the rotor.

The rotating force generated from the drive unit 3 is transmitted to the compression unit 5 to compress or discharge refrigerant. The compression unit 5 includes a fixed scroll and a turning scroll.

The fixed scroll remains fixed in the electric compressor 1. The turning scroll is installed to eccentrically rotate relative to the fixed scroll and compress refrigerant during the relative motion.

The rear housing 100 is disposed on one end of the intermediate housing 2*b*. In detail, based on FIG. 2, the rear housing 100 is brought into close contact with a right end of the intermediate housing 2*b* and is selectively removably mounted to the intermediate housing 2*b*. Refrigerant discharged from the compression unit 5 is discharged at a predetermined pressure toward the discharge chamber 110 through a through hole via a back pressure chamber. Since the pressure of refrigerant discharged toward the discharge chamber 110 is about 30 bar, a noise may be generated.

The electric compressor 1 in accordance with the embodiment of the present disclosure includes the rear housing 100 having the discharge chamber 110 into which refrigerant is discharged, and an oil separator 200 which is disposed in the discharge chamber 110 and has a refrigerant inlet hole 202 into which the refrigerant is drawn. The discharge chamber 110 protrudes in a multi-stepped manner outwards from the rear housing 100 such that the volume of the rearing housing 100 is increased. Based on the oil separator 200, the internal space of the discharge chamber 110 is divided into two spaces having different volumes.

The discharge chamber 110 includes a first chamber 112 which partially protrudes a predetermined length in a protruding direction from the rear housing 100, a second chamber 114 which partially protrudes from a protruding end of the first chamber 112 at one side based on the oil separator 200, and a third chamber 116 which directly protrudes in the protruding direction at the other side based on the oil separator 200.

The first to third chambers 112, 114, and 116 derive a noise reduction due to an increased volume when refrigerant is discharged. Unlike the discharge chamber according to the conventional art that have a limited volume, the discharge chamber 110 is configured to have an increased volume at a specific ratio so as to reduce a vibration noise caused by discharge of refrigerant.

In this embodiment, the first chamber 112 is disposed adjacent to the second chamber 114 and is formed to have a predetermined size at one side based on a central portion of the discharge chamber 110. For example, the first chamber 112 protrudes in a crescent shape outward from the rear housing 100.

When refrigerant is discharged into the discharge chamber 110, an impact corresponding to the above-mentioned pressure range is applied to the discharge chamber 110. Here, if the volume of the discharge chamber 110 increases, a noise may be reduced by a diffusion effect.

Furthermore, in the present disclosure, to prevent the stiffness of the rear housing 100 from deteriorating due to noise and vibration generated by the discharge of refrigerant, the rear housing 100 is stably supported by a rib 300, which will be described later herein, whereby the structural stability may be enhanced.

The second chamber 114 is disposed in the central portion of the discharge chamber 110 at a position adjacent to the first chamber 112. For example, the second chamber 114 may be disposed on one side of the oil separator 200. The second chamber 114 has a volume greater than that of the first chamber 112 or the third chamber 116, taking into account the fact that discharge of refrigerant is performed at a position facing the second chamber 114.

In other words, it is preferable that the second chamber 114 be disposed at the above-mentioned position because the second chamber 114 can diffuse refrigerant discharged toward the discharge chamber 110 in a radial shape at the position facing the refrigerant, whereby the effect of reducing noise and vibration can be increased. Furthermore, it may be preferable that the layout shown in the drawings be maintained because the noise reduction effect can be enhanced without complicating the layout of the rear housing 110.

Since the volume of the second chamber 114 is greater than that of the first chamber 112, space provided for diffusion of refrigerant during discharge of the refrigerant can be reliably secured, whereby the noise reduction effect can be enhanced.

The second chamber 114 is partially enclosed by the first chamber 112 in a circumferential direction. In this case, pressure fluctuation due to discharge of refrigerant is primarily diffused in the first chamber 112 and then additionally diffused in the second chamber 114. Hence, this structure is advantageous for reducing vibration and noise.

The second chamber 114 protrudes, in the protruding direction of the rear housing 110, a length greater than that of the first or third chamber 112 or 116. The length that the second chamber 114 protrudes is within a predetermined length range and changes depending on the specifications of the electric compressor.

The third chamber 116 is disposed at the other side of the oil separator 200 based on the drawing and has a volume less than that of the first or second chamber 112 or 114. Taking into account a limited layout of the rear housing 100, the third chamber 116 is disposed in the perimeter of the rear housing 100 to reduce noise due to discharge of refrigerant, and the shape of the third chamber 116 is not limited to that shown in the drawings.

The rear housing 100 includes the rib 300 which is disposed in the second chamber 114 and extends in a circumferential direction of the rear housing 100 so as to minimize generation of vibration due to the discharge pressure of refrigerant discharged from the discharge chamber 110.

The reason why the rib 300 is disposed in the second chamber 114 is because vibration and noise generation rates of the position at which the rib 300 is disposed are highest due to the fact that refrigerant is discharged to the associated position, and therefore impacts are directly applied thereto. Hence, the rib 300 is formed at the associated position, whereby generation of vibration or noise due to discharge of refrigerant may be mitigated, and the rib 300 may also support and reinforce the second chamber 114.

The rib 300 includes a first rib 310 formed in an annular shape in the second chamber 114, and a plurality of second ribs 320 radially extending from the first rib 310.

The first rib 310 has an annular shape. Thus, if vibration is applied to the first rib 310, the vibration is partially transmitted to the second ribs 320 so that the vibration can be dispersed in radial directions of the rear housing 100. Consequently, the overall vibration of the rear housing 100 may be damped.

The first rib 310 is disposed at a position lower than the refrigerant inlet hole 202. In this case, the second ribs 320 may be spaced apart from the refrigerant inlet hole 202 so that vibration can be prevented from being transmitted to the refrigerant inlet hole 202, whereby reliable transfer of refrigerant can be promoted.

Furthermore, in the case the first rib 310 is disposed at the above-mentioned position, vibration and noise which are generated from the second chamber 114 that occupies most of the area of the rear housing 100 may be minimized.

In the present embodiment, the first rib 310 and the second rib 320 may have different thicknesses or the same thickness. In the case where the first and second ribs 310 and 320 have the same thickness, the vibration transmission time and the vibration damping rate may be changed depending on the locations. Hence, appropriate thicknesses of the first and second ribs 310 and 320 may be determined through a plurality of tests and changed depending on the capacity of the electric compressor.

Furthermore, the first and second ribs 310 and 320 may have the shapes shown in the drawings, or may be changed to other shapes. For example, the cross-section of each of the first and second ribs 310 and 320 may have any one of semicircular, elliptical, and polygonal shapes.

In the case where the second ribs 320 extend from the first rib 310, it is preferable that the angle between the second ribs 320 spaced apart from each other remain constant. Even when angles between the second ribs 320 differ from each other, it is preferable that a difference between different angles remain minimized.

In the case where the second ribs 320 extend in the second chamber 114 in a manner shown in the drawing, the structure in which the second chamber 114 is divided into sections having the same area by the second ribs 320 may be advantageous for reducing vibration due to discharge of refrigerant.

However, due to the layout relationship between the second chamber 114 and the oil separator 200, the length of the second rib 320 that extends toward the oil separator 200 is less than that of the second ribs 320 that extends in other directions. The area of a portion of the second chamber 114 that is sectioned by the second rib 320 that extends toward the oil separator 200 is less than that of the other portions.

The thickness of the first rib 310 may be greater than that of the second rib 320. The thickness of the first rib 310 may be determined through a plurality of tests for reinforcement of the second chamber 114.

For example, the thickness of the first rib 310 may be increased or reduced at specific positions depending on the degree of vibration which is generated when refrigerant is discharged toward the rear housing 100.

Although not shown, the thickness of the second rib 320 may be increased at a position at which the magnitude of vibration comparatively increases, and may be reduced at a position at which the magnitude of vibration comparatively reduces. In this way, generation of vibration may be minimized by changing the thickness of the second rib 320 depending on the positions in the rear housing 100, in other words, depending on the degree of vibration at each position.

In the second chamber 114 according to the present embodiment, a fourth rib 340 extends from the first rib 310 toward the oil separator 200. Due to the layout of the rear housing 100, the fourth rib 340 extends a length shown in the drawing, but the extension length of the fourth rib 340 may be increased.

The fourth rib 340 is disposed below the refrigerant inlet hole 202. The reason why the fourth rib 340 is disposed below the refrigerant inlet hole 202 is because it is preferable that a separate obstacle be not present on a flow path so as to secure reliable movement of refrigerant toward the refrigerant inlet hole 202.

In the discharge chamber 110, the ribs 300 are provided at one side adjacent to the oil separator 200, and the ribs 300 are not provided at the other side of the oil separator 200.

Provided for structural reinforcement, the ribs 300 are disposed in the above-mentioned manner, taking into account the layout of the rear housing 100 and spatial limitations.

Figure 5:
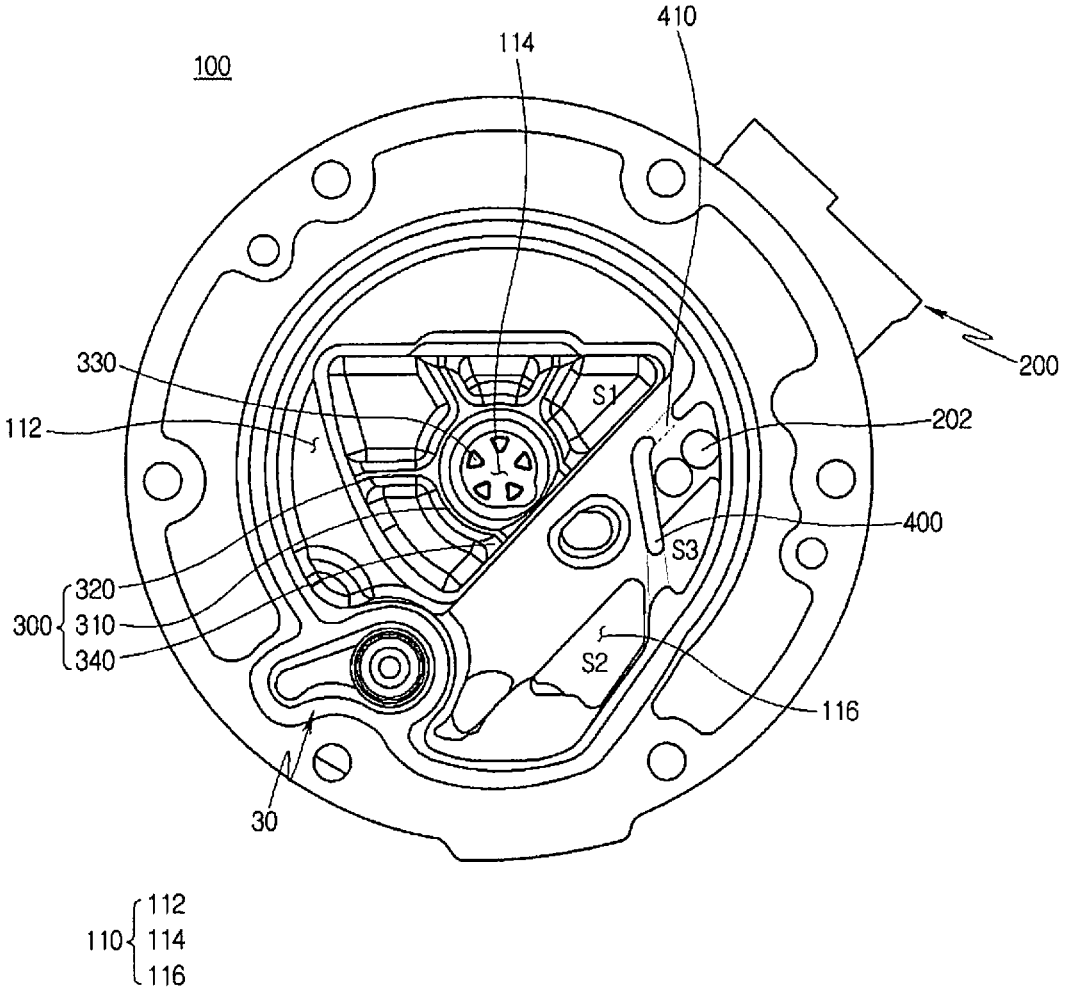
FIG. 5 is a diagram illustrating a third rib provided on a rear housing of an electric compressor in accordance with another embodiment of the present disclosure.

Referring to FIG. 5, a plurality of third ribs 330 separated from each other are provided along a circumferential direction inside the second chamber 114 according to an embodiment of the present disclosure. The third ribs 330 are disposed in a shape shown in the drawing so as to reinforce the stiffness of the central portion of the rear housing 100.

The plurality of third ribs 330 are spaced apart from each other at regular intervals, and the shape of each third rib 330 may be changed in various ways other than the shape shown in the drawing.

The rear housing 100 may have a circular plate shape. A plurality of mounting holes are formed in the perimeter of the rear housing 100 so that the rear housing 100 can be coupled with the intermediate housing 2*b* by bolting. The discharge chamber 110 is formed in a separate region in the rear housing 100, and sealed by a sealing member (not shown) so as to prevent refrigerant from leaking out of the discharge chamber 110 even when the refrigerant is discharged at high pressure to the discharge chamber 110.

In the rear housing 100, the oil separator 200 is disposed in the discharge chamber 110 and has the refrigerant inlet hole 202 through which refrigerant flowing toward the discharge chamber 110 is drawn into the oil separator 200. The oil separator 200 may be disposed at an eccentric position in one side of the rear housing 100. Although there is illustrated the case where two refrigerant inlet holes are formed in a central upper portion of the oil separator 200 based on the longitudinal direction of the oil separator 200, the number of refrigerant inlet holes may be changed.

The oil separator 200 may be slantly disposed in the rear housing 100, and protrude into the discharge chamber 110 that is sectioned by the sealing member.

The oil separator 200 may have a hollow structure. Oil included in refrigerant drawn into the refrigerant inlet hole 202 is comparatively heavy. Thus, due to a difference in specific gravity, oil which is comparatively heavy moves to a lower portion in the oil separator 200, and refrigerant moves to an upper portion in the oil separator 200.

A partition wall 400 according to this embodiment passes through the oil separator 200 and partitions the internal region of the discharge chamber 110 into a plurality of regions. Communication holes 410 are formed in the partition wall 400 at different positions such that the times it takes for refrigerant drawn into the refrigerant inlet hole 202 to move to the communication holes 410 are different from each other.

The communication holes 410 are formed in the partition wall 400, and refrigerant flows through the communication holes 410. In the discharge chamber 110, a phase difference is generated due to a difference in the times it takes refrigerant to be drawn into the communication holes 410. Thereby, pulsation noise is reduced.

In order to reliably separate, using a different in specific gravity, oil from refrigerant that is drawn into the refrigerant inlet hole 202, it is preferable that the refrigerant inlet hole 202 be disposed at an upper portion of the oil separator 200 based on the longitudinal direction of the oil separator 200.

The reason for this is because of the fact that, while refrigerant moves downwards along the longitudinal direction of the oil separator 200, oil can be reliably separated from the refrigerant, and pure gas-phase refrigerant can be comparatively easily collected.

The partition wall 400 is machined to have a shape shown in the drawing through a cutting process. The communication hole 410 is formed through a primary hole forming process using a drill and an additional machining process.

The electric compressor 1 further includes a filter unit 30 configured to filter oil separated from refrigerant by the oil separator 200. The filter unit 30 is provided to filter out foreign substances from the oil separated from the refrigerant by the oil separator 200. The filter unit 30 includes a filter body having a mesh shape, and a filter frame in which the filter body is seated.

The installation position of the filter unit 30 in the discharge chamber 110 may be changed depending on the position of the oil separator 200 so as to filter oil separated from refrigerant before the oil discharged through an oil discharge hole (not shown) formed in the lower portion of the oil separator 200 is supplied to the drive unit 3 of the electric compressor 1.

As shown in an embodiment of the present disclosure, in the case where the oil separator 200 is disposed at an eccentric position in one side of the rear housing 100, the filter unit 30 is also disposed at the right side of the oil separator 200 that corresponds to the one side, as shown in the drawing.

Since the electric compressor 1 according to the present embodiment is installed in an air conditioning system for a vehicle, transfer of vibration or noise into the passenger compartment of the vehicle can be minimized, quiet driving conditions can be maintained.

The discharge chamber 110 includes a first region S1 having a largest area among a plurality of regions disposed at different positions by the oil separator 200, a second region S2 having an area comparatively smaller than that of the first region S1, and a third area S3 disposed adjacent to the refrigerant inlet hole 202 at a position neighboring the second region S2.

The first to third regions S1 to S3 are maintained in the same region, but are partitioned based on the oil separator 200 in a manner shown in the drawing. The noise reduction effect may be mainly achieved in the first and second regions S1 and S2. The third region S3 may function to reduce noise generated while refrigerant is drawn into the refrigerant inlet hole 202. Also, the third region S3 along with the first and second regions S1 and S2 may have an auxiliary noise reduction function.

The first region S1 may have a semicircular shape. While refrigerant discharged into the first region S1 is diffused in the first region S1 or moved in a circumferential direction, noise reduction may be obtained.

Figure 6:
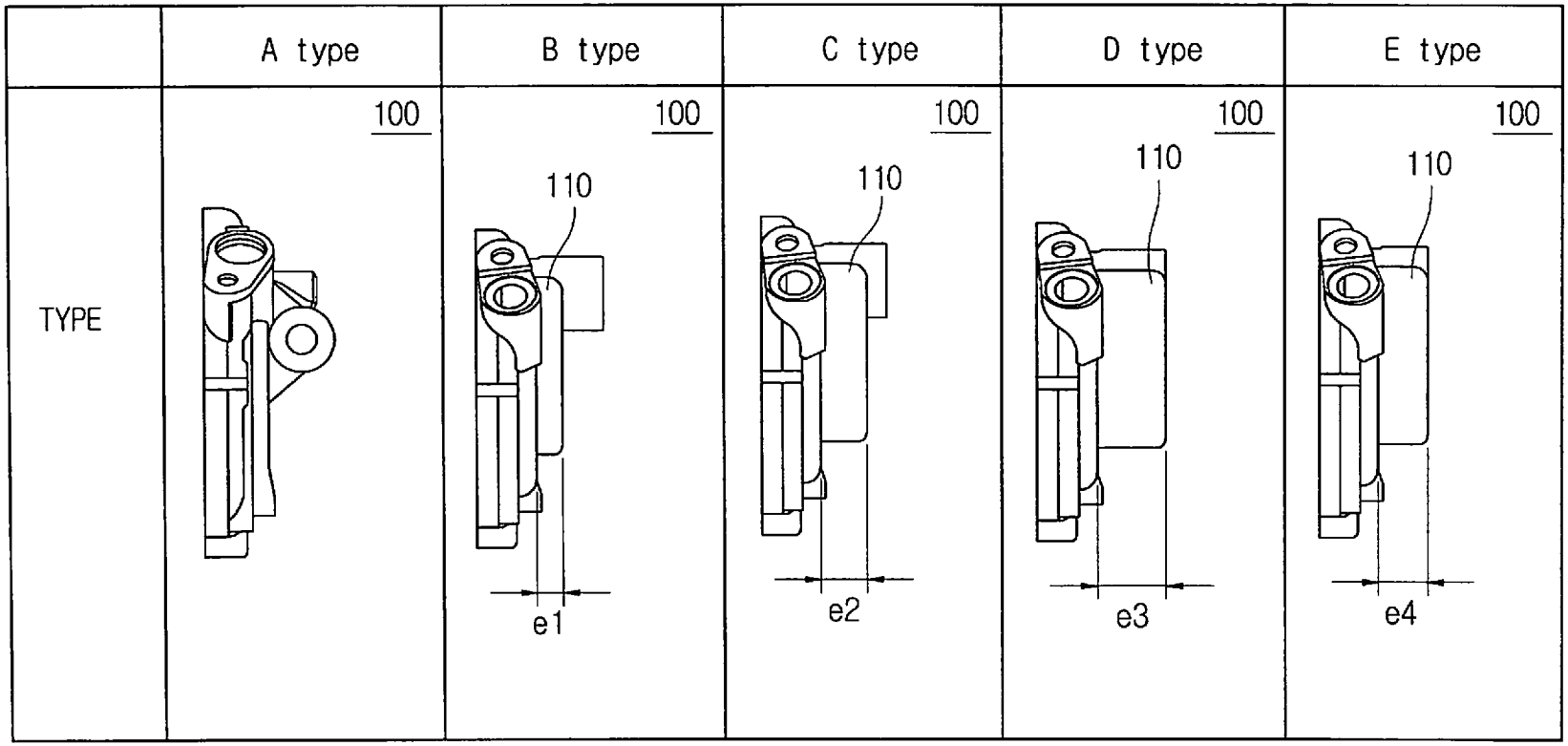
FIG. 6 is a side view illustrating various embodiments of a discharge chamber formed in the rear housing.

Referring to FIG. 6, a volume ratio of the discharge chamber 110 according to the present embodiment may be determined depending on an internal volume V1 having a predetermined size and a discharge capacity (cc) of refrigerant which is discharged into the discharge chamber 110.

For example, the volume ratio of the discharge chamber 110 may be a value obtained by dividing the internal volume V1 of the discharge chamber 110 by the refrigerant discharge capacity (cc). The volume ratio of the discharge chamber 110 ranges from 2.0 to 3.2.

The rear housing provided in the electric compressor may be formed in various types including type A to type E. The rear housing 100 of type A may correspond to the type in which the protrusion rate of the discharge chamber 110 is very low.

In the rear housing 100 of type B, the discharge chamber 110 is provided, and protrudes a length corresponding to 'e1'. In the rear housing 100 of type C, the discharge chamber 110 protrudes a length corresponding to 'e2'. In the rear housing 100 of type D, the discharge chamber 110 protrudes a length corresponding to 'e3'. In the rear housing 100 of type E, the discharge chamber 110 protrudes a length corresponding to 'e4'.

In all of the rear housings 100 of types A to E, the internal volume and the refrigerant discharge capacity are different. The refrigerant discharge capacity is the constant, but the internal volumes of the rear housings 100 differ from each other.

For example, the internal volume of the rear housing 100 of type A is 61 cc, which is smallest. The internal volume of the rear housing 100 of type D is 117 cc, which is largest. The weights of the rear housings of types A to E differ from each other. The weight of the rear housing 100 of type A is 462 g, which is smallest. The weight of the rear housing 100 of type D is largest.

Depending on the length of the discharge chamber 110 protruding outward from the rear housing 100, the volume ratio of the discharge chamber 110 ranges from 2.0 to 3.2. The rear housing can be designed such that the noise reduction performance is maximized depending on the volume ratio.

When the volume ratio of the discharge chamber 110 of the rear housing 100 is less than 2.0, excessive noise may be generated. In the case where the volume ratio exceeds 3.2, noise is increased. Therefore, it is preferable that the volume ratio of the rear housing 100 fall within the above-mentioned volume ratio range.

Figure 7:
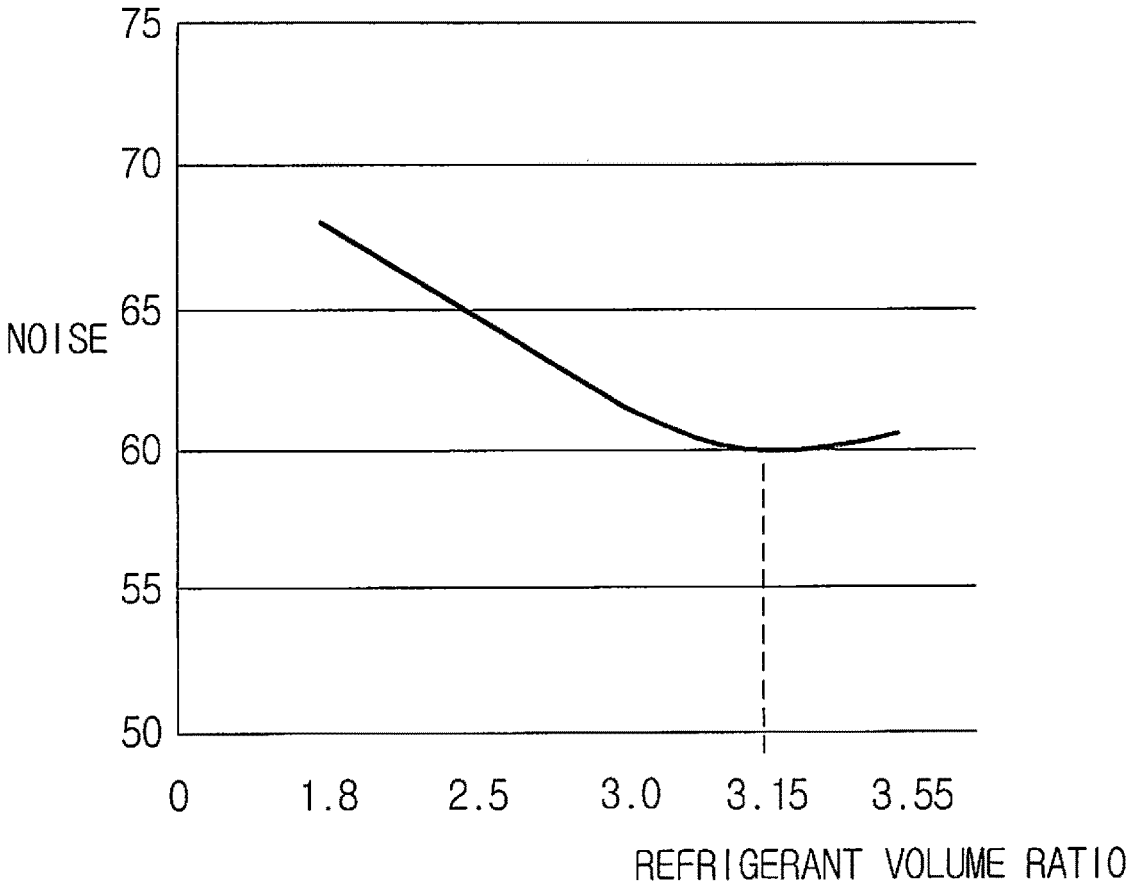
FIG. 7 is a graph showing a noise reduction effect as a function of a volume ratio of the discharge chamber in accordance with an embodiment of the present disclosure.

Referring to FIG. 7, the volume ratio of the discharge chamber 110 according to the present embodiment may be determined depending on an internal volume V1 having a predetermined size and a discharge capacity (cc) of refrigerant which is discharged into the discharge chamber 110.

As shown in the graph showing noise of the Y-axis as a function of the refrigerant volume ratio of the X-axis, noise generated from the rear housing is minimized when the volume ratio is 3.1.

Therefore, if a rear housing having this volume ratio is selected and applied to the electric compressor, the effect of reducing noise generated by discharge of refrigerant may be maximized.

Figure 8:
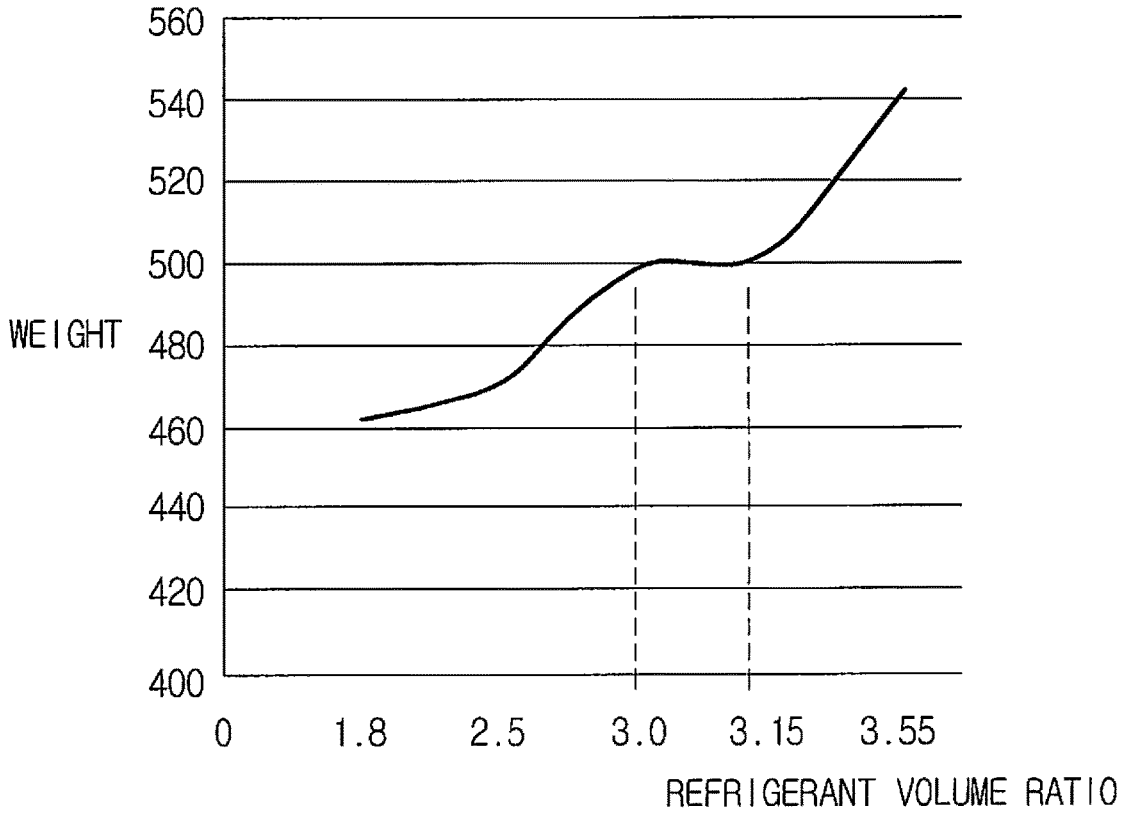
FIG. 8 is a graph showing a weight as a function of the volume ratio of the discharge chamber in accordance with an embodiment of the present disclosure.

Referring to FIG. 8, with regard to noise as a function of the refrigerant discharge capacity according to the weight of the rear housing, it is to be understood that a rear housing having a volume ratio ranging from 3.0 to 3.15 has an excellent effect of reducing noise generated by discharge of refrigerant. Furthermore, when the volume ratio of the discharge chamber 110 of the rear housing is greater than 3.15 or 3.2, noise is rather increased. Therefore, it is most preferable that the volume ratio of the discharge chamber 110 of the rear housing fall within the above-mentioned volume ratio range.

In the present embodiment, the length that the discharge chamber 110 protrudes outward from the rear housing 100 ranges from 14 mm to 30 mm. In this range, the effect of reducing noise generated by discharge of refrigerant is most excellent.

Various embodiments of the present disclosure provide an electric compressor having a structure capable of minimizing vibration and noise which are generated by discharge of refrigerant, which is working fluid of the electric compressor, and preventing problems due to pulsation pressure from occurring, thus making it possible for a target structure provided with the electric compressor to be quietly operated.

In various embodiments of the present disclosure, the overall structural strength of the rear housing may be enhanced by improving the structure of the rear housing such that the discharge chamber can be increased in volume and structurally reinforced.

While the present disclosure has been described with respect to the specific embodiments, it will be apparent to those skilled in the art that various changes and modifications may be made without departing from the spirit and scope of the disclosure as defined in the following claims.

What is claimed is:

1. An electric compressor comprising:

a rear housing having a discharge chamber into which refrigerant is discharged; and an oil separator disposed in the discharge chamber and having a refrigerant inlet hole through which the refrigerant is drawn into the oil separator is slantly disposed in the rear housing, wherein the discharge chamber protrudes in a multi-stepped manner outwards from the rear housing such that a volume of the rear housing is increased, and based on the oil separator, an internal space of the discharge chamber is divided into spaces having different volumes, wherein a volume ratio of the discharge chamber is determined according to a length of the discharge chamber protruding outward from the rear housing, wherein the electric compressor, characterized in that the volume ratio of the discharge chamber is determined according to a length of the discharge chamber protruding outward from the rear housing, wherein the discharge chamber comprises;

a first chamber partially protruding a predetermined length in a protruding direction from the rear housing;

a second chamber partially protruding from a protruding end of the first chamber at one side based on the oil separator, wherein a rib extending in a circumferential direction of the rear housing is provided in the second chamber, wherein the rib comprises;

a first rib formed in an annular shape in the second chamber;

a plurality of second ribs radially extending from the first rib, wherein the rear housing has a plurality of mounting holes formed in the circumference of the rear housing, and the rib is extended in a radial shape from the discharge chamber to a mounting hole of the plurality of mounting holes.

2. The electric compressor according to claim 1, wherein the discharge chamber further comprises:

a third chamber directly protruding in the protruding direction at the other side based on the oil separator.

3. The electric compressor according to claim 1, wherein the second chamber has a volume greater than a volume of the first chamber or the third chamber.

4. The electric compressor according to claim 1, wherein a length that the second chamber protrudes in the protruding direction of the rear housing is greater than a length of the first or third chamber protrudes.

5. The electric compressor according to claim 1, wherein a plurality of third ribs separated from each other are provided inside the second chamber along a circumferential direction of the second chamber.

6. The electric compressor according to claim 1, wherein a thickness of the first rib differs from a thickness of the second rib.

7. The electric compressor according to claim 1, wherein a thickness of the first rib is greater than a thickness of the second rib.

8. The electric compressor according to claim 1, wherein the oil separator is eccentrically disposed at one side based on a center of the rear housing.

9. The electric compressor according to claim 1, wherein a partition wall is disposed at one side of the discharge chamber, and provided to partition the internal space of the discharge chamber into different regions.

10. The electric compressor according to claim 9, wherein communication holes are formed in the partition wall at different positions.

11. The electric compressor according to claim 1, wherein the volume ratio of the discharge chamber is determined depending on an internal volume of the discharge chamber having a predetermined size and a discharge capacity of refrigerant which is discharged into the discharge chamber, and wherein the volume ratio of the discharge chamber is a value obtained by dividing the internal volume of the discharge chamber by the refrigerant discharge capacity, and the volume ratio of the discharge chamber ranges from 2.0 to 3.2.

12. The electric compressor according to claim 1, wherein the discharge chamber includes:

a first region having a largest area among a plurality of regions disposed at different positions by the oil separator;

a second region having an area comparatively smaller than an area of the first region; and a third area disposed adjacent to the refrigerant inlet hole at a position neighboring the second region.

13. The electric compressor according to claim 12, wherein the first region has a semicircular shape, and while refrigerant discharged into the first region is diffused in the first region or moved in a circumferential direction, noise reduction is obtained.

14. The electric compressor according to claim 1, wherein, in the discharge chamber, a rib is formed at one side adjacent to the oil separator, and the rib is not formed at the other side of the oil separator.

* * * * *